US007316184B2

(12) United States Patent
Schneider et al.

(10) Patent No.: US 7,316,184 B2
(45) Date of Patent: Jan. 8, 2008

(54) DRIER FOR A WEB OF MATERIAL

(75) Inventors: Georg Schneider, Würzburg (DE); Wolfgang Otto Reder, Veitshöchheim (DE); Karl Erich Albert Schaschek, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 364 days.

(21) Appl. No.: 10/531,065

(22) PCT Filed: Jul. 9, 2003

(86) PCT No.: PCT/DE03/02296

§ 371 (c)(1),
(2), (4) Date: Apr. 12, 2005

(87) PCT Pub. No.: WO2004/035313

PCT Pub. Date: Apr. 29, 2004

(65) Prior Publication Data

US 2006/0021245 A1 Feb. 2, 2006

(30) Foreign Application Priority Data

Oct. 16, 2002 (DE) ..... 102 48 249

(51) Int. Cl.
*B41F 23/04* (2006.01)

(52) U.S. Cl. ..... 101/424.1; 34/636; 34/651

(58) Field of Classification Search ..... None
See application file for complete search history.

(56) References Cited

U.S. PATENT DOCUMENTS

| | | | | |
|---|---|---|---|---|
| 3,093,069 | A * | 6/1963 | Luehrs | 101/179 |
| 4,831,926 | A * | 5/1989 | Bowman et al. | 101/138 |
| 5,353,979 | A | 10/1994 | Gartmann | |
| 5,640,906 | A | 6/1997 | Schmitt | |
| 6,176,184 | B1 * | 1/2001 | Mudry | 101/424.1 |
| 6,178,883 | B1 * | 1/2001 | Satoh et al. | 101/424.1 |
| 2005/0016401 | A1 * | 1/2005 | Takahashi et al. | 101/424.1 |
| 2005/0257702 | A1 * | 11/2005 | Eckert et al. | 101/180 |

FOREIGN PATENT DOCUMENTS

| | | |
|---|---|---|
| DE | 40 33 642 A1 | 4/1992 |
| DE | 41 33 555 A1 | 4/1993 |
| DE | 44 29 891 A1 | 2/1996 |
| DE | 298 19 202 U1 | 3/1999 |
| DE | 100 44 676 A1 | 4/2002 |
| FR | 2184036 | 12/1973 |

* cited by examiner

*Primary Examiner*—Jill E. Culler
(74) *Attorney, Agent, or Firm*—Jones, Tullar & Cooper, PC

(57) ABSTRACT

A dryer is used for drying a web of material. The dryer includes a passage duct for the material web. Drying takes place within this passage duct which includes at least one straight section. The dryer is disposed on a printing group which includes vertical web guidance. The passage duct straight section is essentially horizontal and receives the web of material delivered to it by the printing group. The passage duct is comprised of at least two sections through which the web of material travels in opposite directions.

13 Claims, 3 Drawing Sheets

DRIER FOR A WEB OF MATERIAL

CROSS-REFERENCE TO RELATED APPLICATIONS

This U.S. patent application is the U.S. national phase, under 35 USC 371, of PCT/DE2003/002296, filed Jul. 9, 2003; published as WO 2004/035313 A1 on Apr. 29, 2004, and claiming priority to DE 102 48 249.7, filed Oct. 16, 2002, the disclosures of which are expressly incorporated herein by reference.

FIELD OF THE INVENTION

The present invention is directed to a dryer for a web of material. The dryer has a transit channel for the web of material in which the drying takes place and which has at least one straight section.

BACKGROUND OF THE INVENTION

If a paper web is processed in a folding apparatus immediately after having been imprinted, without the printing ink having had sufficient time for drying, there is the danger that, because of the contact of the paper web with the rollers of the folding apparatus, ink may be smudged or may be transferred from one web to another web because of the contact between several webs of material being processed simultaneously in the folding apparatus. Modern printing presses attain such high web speeds that the length of time between the imprinting of a web section and its arrival at the folding apparatus is of a length of only a few fractions of a second. Sufficient drying of the ink is not possible during this length of time if it is not speeded up by the provision of technical aids.

Drying devices for drying a freshly imprinted web of material are shown, for example, in DE 41 33 555 A1 or DE 44 29 891 A1.

DE 41 33 555 A1 describes a rotogravure printing press with several printing rollers for use in multi-color printing. After passing over every individual printing roller, a web of material travels over a transport path whose direction is changed by several rollers, on which transport path drying devices are arranged. Here, the course of the transport path has been selected in such a way that the first change of direction effecting rollers, over which the web of material runs after having passed through a printing gap, touch the non-printed back of the web. Only after the web has passed through the drying devices, and there is no longer a danger of smudging the ink, by contact with the change of direction roller, change of direction rollers follow, which also touch the imprinted surface of the web.

In connection with printing presses, for use in imprinting both sides of a paper web, the construction described in DE 41 33 555 A1 cannot be used. Contact of the freshly imprinted web with a change of direction roller, or with any other arbitrary surface, is to be avoided so long as the printing ink has not dried completely.

DE 44 29 891 A1 therefore uses a longitudinally extending drying oven for drying a web which is imprinted on the front and back, and through which the printed web runs in a straight line. It would be desirable to be able to conduct the web vertically upward, in the same direction in which it leaves the printing group, through the drying oven in order to prevent, in this way, contact of the not yet completely dried printed web with a change of direction roller. However, such an arrangement would require a structural height of several meters. Therefore, it would be difficult to install such a machine in a work room. To avoid this, and to be able to install the drying oven horizontally, a change of direction roller between the outlet of the printing group and the inlet of the drying over has to be accepted. Although an arrangement with a horizontally oriented drying oven described in the above-mentioned publication does not require any additional external height of the work room for its installation, it does require a considerable base area, since a length of several meters of the drying oven is required to achieve a dwell time in the drying oven which is sufficient for drying the ink on the imprinted web of material Although a portion of this base area can be used for installing roll changers for the printing group underneath the drying oven, for reducing the space requirement of such a printing installation it is necessary to be able to reduce the length of the drying oven. This requirement for length reduction occurs, to a greater extent, as a function of the higher the web speeds are in the printing installation. To assure sufficient web drying, with increasing web speeds, it is necessary, in connection with the known construction, to increase the length of the drying oven proportionally to the web speed.

DE 298 19 202 U1 discloses a dryer in which a web of material is rerouted. This dryer uses turning stations on which air is blown.

DE 100 44 676 A1 and DE 40 33 642 A1 show devices for rerouting a web of material by the use of compressed air.

SUMMARY OF THE INVENTION

The object of the present invention is directed to providing dryers for webs of material.

In accordance with the present invention this object is attained by the provision of a web dryer that has a transit channel through which the web of material passes. The transit channel has at least one straight section. The web dryer is arranged on a web printing group with vertical guidance of the web. The transit channel has at least one section in which the web is guided horizontally. A plurality of air outlet nozzles can be located in at least one of these sections.

The advantages which can be gained by use of the dryer for a web of material, in accordance with the present invention, consist, in particular, in that the dryer can be constructed in a very compact manner and requires no change of direction rollers which come into contact with the webs of material before they are completely dried. This is accomplished because, instead of change of direction rollers, curved change of direction surfaces, which are equipped with air outlet openings, are employed in the transit channel of the dryer. By creating air cushions, by the use of the air exiting between the change of direction surfaces and the web of material looped around them, an extremely low-friction guidance of the web of material is made possible. Also, contact of the web of material with a surface, which could lead to smudging of the ink, is prevented. For providing a uniform air cushion between the change of direction surface and the web of material, it is desirable that the change of direction surface has a radius of curvature which is minimal at an vertex line of the change of direction surface and which increases towards each of the edges of the change of direction surface. In particular, such a change of direction surface can have a hyperbolic cross section, particularly in connection with change of direction angles of 90°, or a semi-elliptical cross section.

Air outlet openings are preferably arranged along the vertex line of the change of direction surface.

By the provision of a plurality of such change of direction surfaces, it is possible to conduct a web of material, which is to be dried in a compact volume, over a great length. Accordingly, long dwell times of the web in the dryer can be achieved, even at high web speeds. For intensifying the drying effect, the dryer preferably has heat sources, such as, for example, in the form of heat radiators, arranged in the transit channel.

The drying effect can also be intensified by increasing air movement. For this reason, air outlet nozzles, which are directed onto the web of material, have therefore been provided in the at least one straight section of the transit channel. A heating device in a supply line of the nozzles, for use in heating the air exiting through these nozzles, can be advantageously assigned to these air outlet nozzles. In particular, the heating device can be a burner.

In a dryer, in whose transit channel a plurality of sections, provided with air outlet nozzles have been arranged, a heating device is preferably provided in the air supply line of the nozzles of at least one of the sections which is located upstream, in the running direction of the web of material, while such a heating device is lacking in the air supply line of the nozzles of at least one section which is located downstream, in the running direction of the web of material. While the web of material is heated in this way in the upstream-located section of the dryer for the web of material and drying of the web of material is thus intensified, the downstream-located section of the dryer makes possible a rapid cooling of the web of material.

A pressure pump can be arranged in a supply line for the nozzles and is operable for driving the air flow through the nozzles. However, instead of this, or in addition it is also possible to provide a suction pump for use in generating a negative pressure in the transit channel. Such negative pressure makes drying easier by lowering the boiling temperature of the ink components which are to evaporate. Moreover, it can be used for driving an air flow through the nozzles.

To achieve a large web length, along with a compact construction, the transit channel preferably has at least two sections through which at least two sections the web of material moves in opposite directions. In this case, a first section preferably extends from an inlet of the dryer over a first distance in a first direction. A second section, which follows the first section via a change of direction surface, extends over a second distance which is greater than the first distance and which extends in the opposite direction. Therefore, the dryer extends from the dryer inlet in two opposite directions, which structure simplifies the mounting of the dryer on a printing group, even if the dryer extends in the first direction, or in the second, opposite direction, beyond the printing group.

BRIEF DESCRIPTION OF THE DRAWINGS

Preferred embodiments of the present invention are represented in the drawings and will be explained in greater detail in what follows.

Shown are in.

DESCRIPTION OF THE PREFERRED EMBODIMENTS

Figure 1:
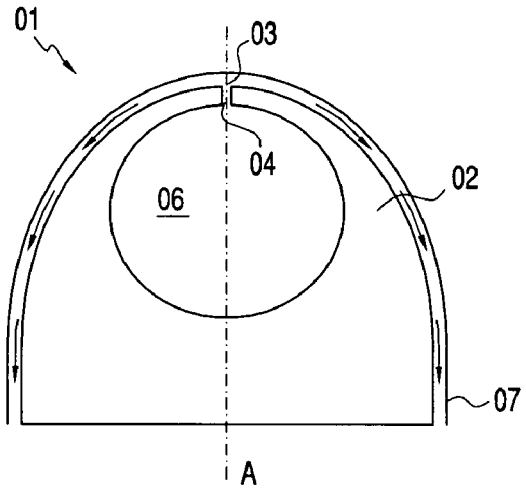
FIGS. 1 and 2, schematic sectional views of a change of direction surface for accomplishing the contactless change of direction of a web of material, in FIG. 3, a basic view of a dryer, and in FIGS. 4 to 7, several preferred embodiments of a dryer in accordance with the present invention and mounted on a printing group.

A schematic, cross-sectional view through a change of direction surface 01, which is also called an air saddle 01 in what follows, and which is used for changing the direction of travel of a material web 07, for example a paper web 07, over an angle of 180° is represented in FIG. 1. The air saddle 01 has a housing 02, typically in the shape of an ellipse which has been halved along its short diameter, and which housing 02 extends in the transverse direction of the web 07 of material, in the direction perpendicular in relation to the drawing plane of FIG. 1. The housing 02 can be made of sheet steel, a rigid plastic plate or the like. The cross section of the housing 02 is symmetrical with respect to a plane A which intersects the housing 02 along a vertex line 03. The housing 02 is provided with a plurality of air outlet openings 04 spaced along the vertex line 03, which air outlet openings 04 communicate with a compressed air duct 06 extending in the interior of the housing 02 in the longitudinal direction of the latter. Compressed air exiting the air outlet openings 04 is distributed between the housing 02 and a web 07 of material looped around the housing 02. In this way, an air cushion is formed and which maintains the web 07 of material at a distance from the surface of the housing 02. The amount of excess pressure between the housing 02 and the web 07 of material, which is required for maintaining an air cushion of a thickness of typically 0.3 to 0.5 mm, is a function of the tension in the web 07 of material. It is therefore possible to provide pressure sensors on the surface of the housing 02 around which the web 07 of material is looped, and also in the compressed air duct 06. By the use of the values measured by these pressure sensors, the web tension is controlled. If necessary, an emergency stop of a press containing the change of direction surface on air saddle 01 can be initiated if the detected pressure indicates a web tear or another error.

Figure 2:
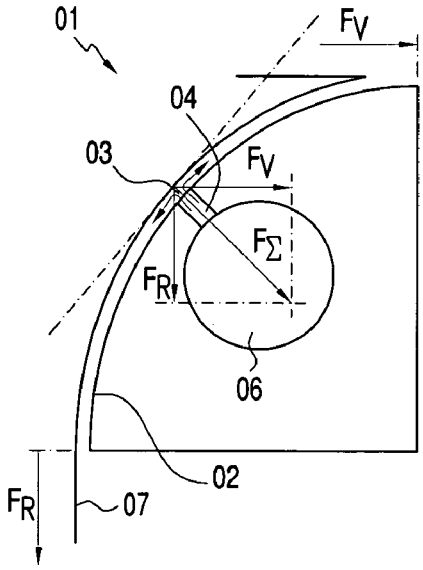

FIG. 2 shows a sectional view, analogous to the one shown in FIG. 1, through an air saddle 01 with a change of direction angle of 90°. The functional principle of operation of this air saddle 01 of FIG. 2 is the same as with the air saddle 01 in FIG. 1. Air, which exits through the compressed air duct 06 and through the spaced air outlet openings 04, which are arranged along a vertex line 03 of the housing 02, is distributed between the surface of the housing 02 and a web 07 of material looped around the housing 02 and, in this way, creates an air cushion which allows a substantially friction-free conveyance of the web of material 07.

In a structure, which is different from the preferred embodiments shown in FIGS. 1 and 2, half an air saddle could also have an asymmetric cross section. In such a case, the vertex line 03 of the housing 02 is defined as that line on the surface of the housing 02 which contacts an imaginary plane that extends perpendicularly with relation to a sum $F_\Sigma$ of the tensile force vectors $F_V$, $F_R$ acting on the web 07 of material upstream and downstream of the change of direction surface 01. The amount of air put through the change of direction surface 01 required for building up an air cushion is reduced.

Figure 3:
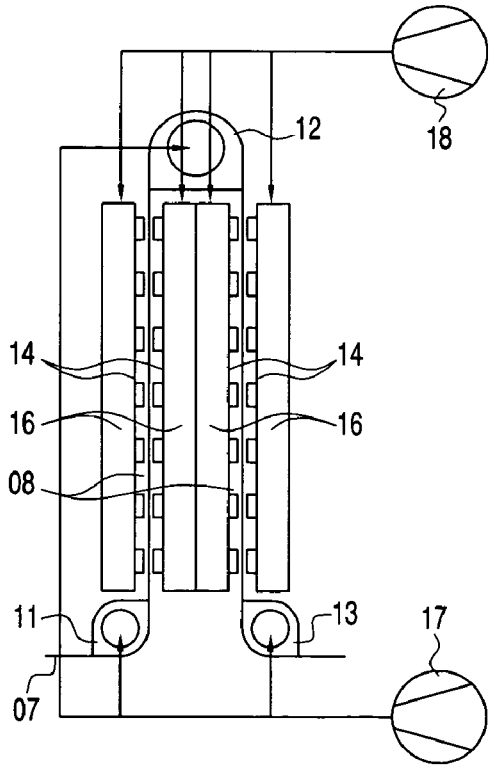

FIG. 3 shows a basic view of a dryer equipped with air saddles 11, 12, 13 in accordance with FIG. 1 or 2. The direction of a web 07 of material to be dried is changed by 90° at a circumferential face 11, for example at an air saddle 11, such as, for example, an inlet air saddle 11. The changed web direction then extends straight through a transit channel 08, for example through a first gap 08 between two plates 14, which are provided with air outlet nozzles. The web direction then loops around a circumferential face 12, such as an air saddle 12, and, for example, a 180° air saddle 12, and passes through a second gap 08 to a circumferential face 13, which may be, for example, an air saddle 13, such as, for example, an outlet air saddle 13, and leaves the dryer from outlet air saddle 13 extending in a horizontal direction. Each of the plates 14, which are provided with air outlet openings, delimits chambers 16 which, like the compressed air ducts 08 of the air saddles 11, 12, 13, are connected with a pressure pump. Two pressure pumps 17, 18 are represented in FIG. 3, one of which supplies the air saddles 11, 12, 13, and the other of which supplies the chambers 16. It is necessary to supply the air saddles 11, 12, 13 with a higher pressure than that which is supplied to the chambers 16. It would, of course, also be possible, in principle, to supply the air saddles 11, 12, 13 and the chambers 16 by the use of a common pressure pump and, in the course of this, to make use of flow resistance in the supply lines leading from the pressure pump to the air saddles 11, 12, 13, or to the chambers 16 in order to provide the air saddles 11, 12, 13 with a higher excess pressure than is provided to the chambers.

Figure 4:
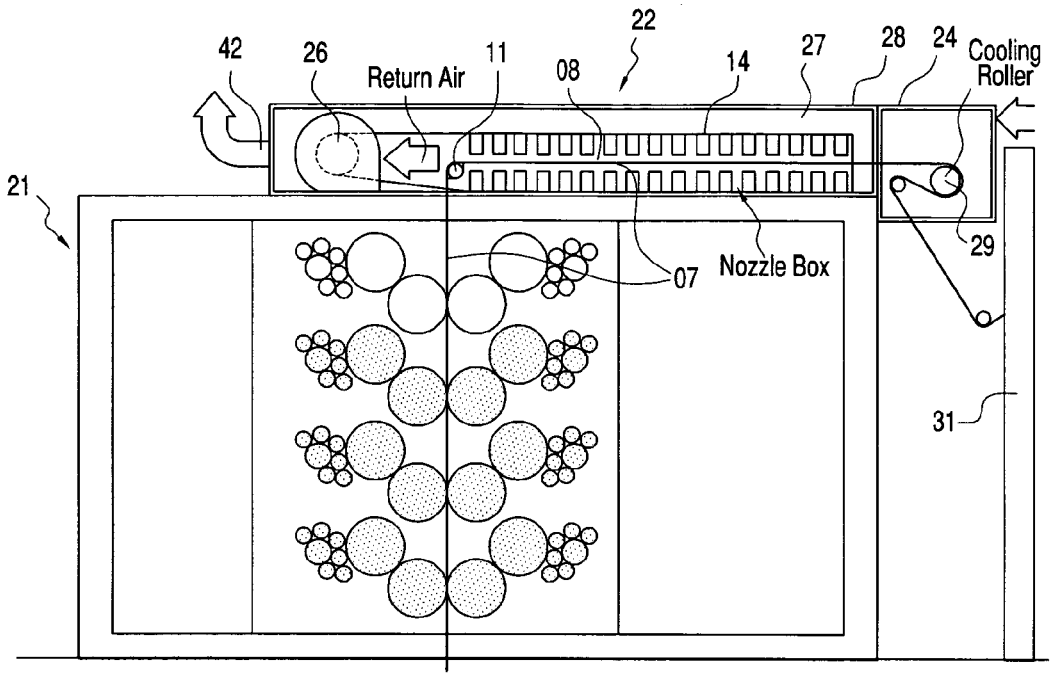

FIG. 4 shows a first preferred embodiment of a dryer 22 mounted on a printing group 21 in accordance with the present invention. A transit channel of an imprinted web 07 of material, which web of material is coming vertically, from below, out of the printing group 21, is comprised of an air saddle 11, such as, for example, a 90° air saddle 11, and with a horizontally oriented gap 08 between plates 14, which are provided with air outlet nozzles, that are not specifically shown in FIG. 4. Except for the nozzles and for an inlet slit and an outlet slit for the web 07 of material, the plates 14 constitute a substantially sealed housing, with which a suction pump 26 is connected for use in generating a negative pressure in the gap 08. The negative pressure causes the inflow of fresh air into the gap 08 via fresh air supply lines 27, which are here constituted by spaces between the plates 14 and an outer housing 28 of the dryer 22. In the first preferred embodiment depicted in FIG. 4, fresh air flows substantially over an outlet 24 of the dryer 22, out of which the web 07 of material is conducted. The fresh air can be pre-heated by a heating device, which is not specifically represented in FIG. 4. The web 07 of material exiting the outlet 24 loops around a cooling roller 29 and finally reaches the folding apparatus 31.

Figure 5:
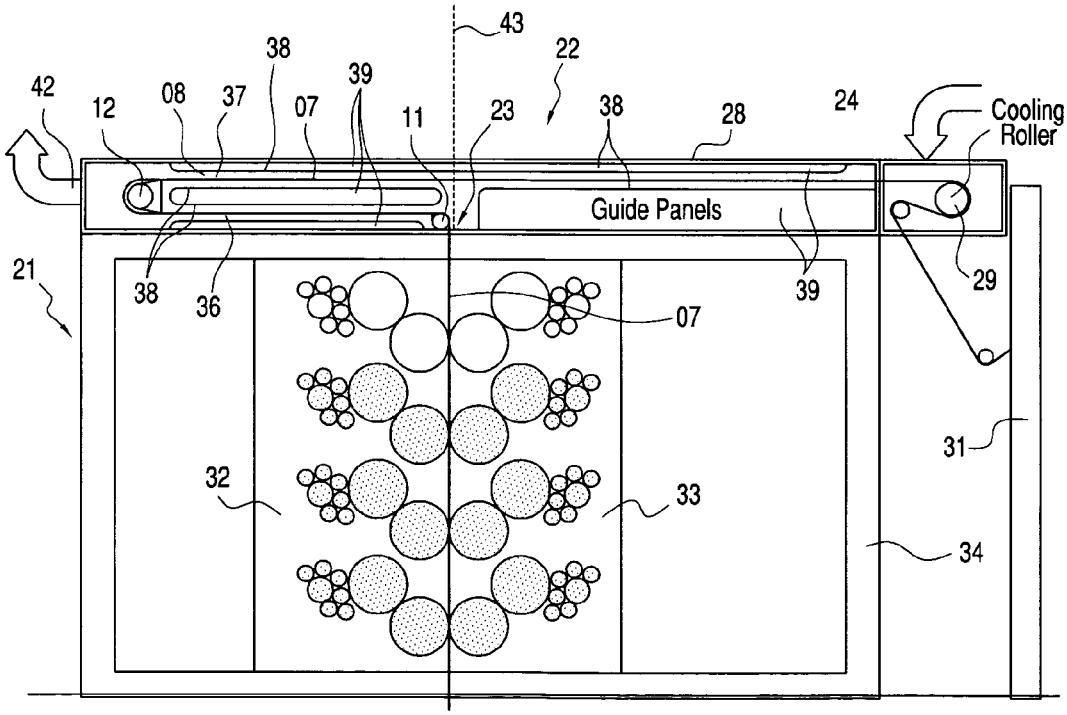

A second preferred embodiment of the present invention is represented in FIG. 5. The printing group 21 is the same as in the first embodiment depicted in FIG. 4. It comprises two component groups 32, 33 containing plate cylinders, each of which plate cylinders in one of the two component groups 32, 33 imprints the same side of the web 07 of material and which component groups 32, 33 can be moved apart in a frame 34 for allowing access to the plate cylinders.

The outer housing 28 of the dryer 22 extends over the entire width of the frame 34. The inlet 23 for the web 07 of material lies approximately in the center of the underside of the housing 28. A 90° air saddle 11 arranged on the underside of housing 28, at the web inlet 23, guides the web 07 of material coming from the printing group 21 into a first horizontal straight section 36 of the transit channel of the dryer 22 which first section 36 extends, starting at the web inlet 23, in a first direction leading away from the folding apparatus 31. At a 180° air saddle 12, the first section 36 makes a transition into a second horizontal straight section 37, which guides the web 07 of material in the second direction, opposite to the first direction, to a web outlet 24 that is adjoining the folding apparatus 31. From web outlet 24, the web 07 of material runs over a cooling roller 29 to the folding apparatus 31.

In relation to a plane 43, which plane 43 is determined by the vertically extending web 07 of material, the first horizontal straight section 36 is arranged on only one side of the plane 43, wherein the second section 37 is arranged on both sides of the plane 43. The second section 37 is at least twice as long as the first section 36.

The two sections 36, 37 of the transit channel, as seen in FIG. 3, are each bordered by guide plates 38, which conduct a fresh air flow, which fresh air enters the housing 28 of the dryer 22 at the web outlet 24 and which fresh air flow is driven by a pump, not represented, closely adjacent to the web 07 of material. The fresh air flow, which can also be pre-heated, moves at high speed along the web 07 of material and, in this way, provides effective drying of the printed web 07. In the embodiment represented in FIG. 3, an air outlet 42 is located on the end of the dryer housing 28 opposite to the web outlet 24. A lower one of the two guides plates 38 bordering the second section 37 is interrupted at the level of the web inlet 23, so that the air flow can be split and a part of this air flow can reach the air outlet 42 along the first section 36. It would, of course, also be possible to provide the air outlet 42 at the inlet 23 for the web 07 of material in order to force the air to flow in this way through the transit channel 08 along its entire length.

In a variation of this second preferred embodiment, the air supply to the first and second straight sections 36, 37 is provided, as in the first embodiment in accordance with FIG. 4, via air chambers 39, which are separated from the transit channel by the guide plates 38, and by nozzles which are formed in the guide plates 38.

Figure 6:
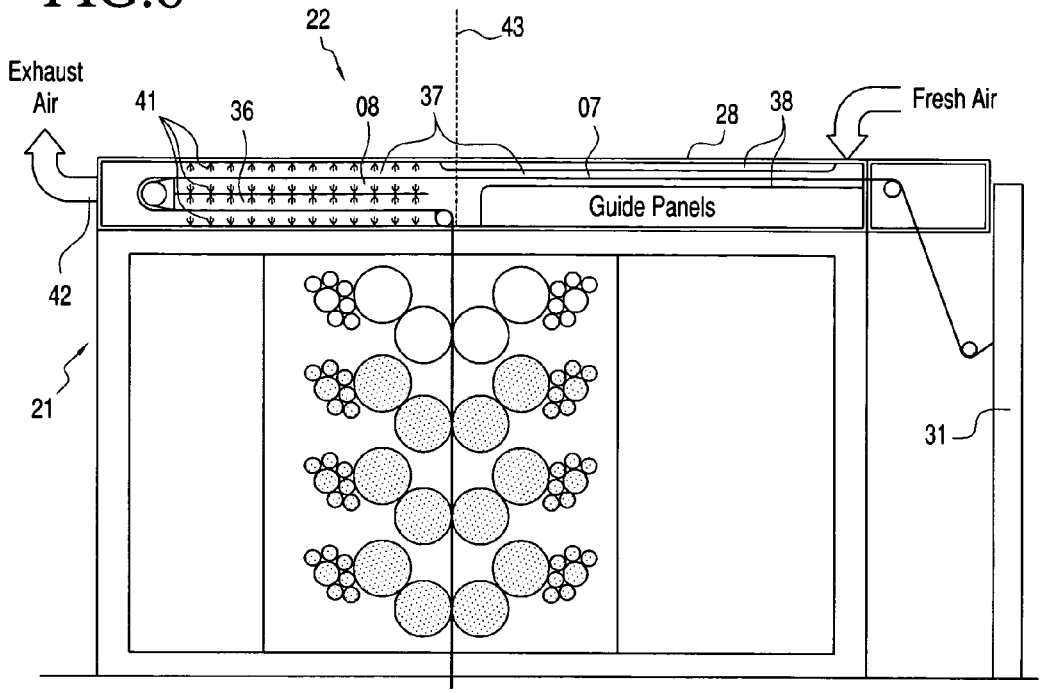

The third embodiment of the present invention, as seen in FIG. 6, differs from the second embodiment shown in FIG. 5 in that the guide plates 38 in the first section 36 of the transit channel 08 and in the first half of the second section 37, which is remote from the folding apparatus 31, have been replaced by heat radiators 41, such as, for example, by electrically operated heating rods. A pump, which is not specifically represented, drives a fresh air flow, which flows through the dryer housing 28 of the dryer 22 from the web outlet 24 to an air outlet 42 that is formed on an oppositely located end face of the dryer housing 28. With this third embodiment the inflowing fresh air need not be pre-heated. To the contrary, it is used for cooling the web 07 of material in the right half of the second section 37 in a counter-flow, so that a cooling roller 29, situated between the dryer 22 and the folding apparatus 31, as used in the first and second embodiments, can be omitted in this third embodiment.

Figure 7:
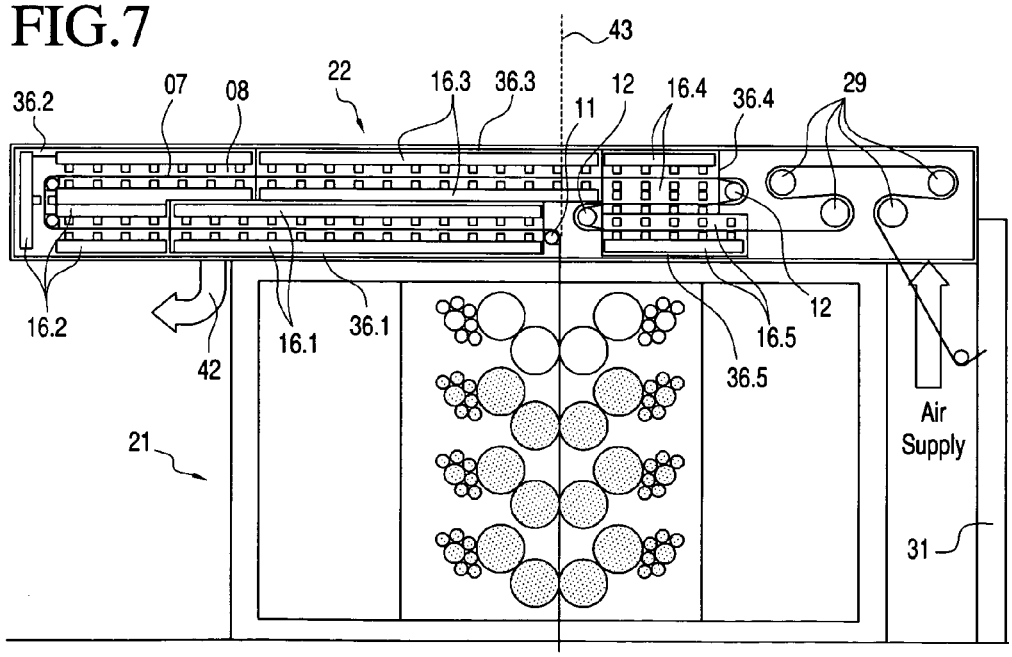

A fourth embodiment of the present invention, for a high drying output, is represented in FIG. 7. As previously shown in FIG. 3, with this fourth embodiment the sections of the transit channel 08, which sections are identified by 36.1 to 36.5, are surrounded by chambers 16.1 to 16.5, whose wall plates facing the sections 36.1 to 36.5 of the transit channel 08 are supplied with air outlet nozzles. A total of five transit channel sections 36.1 to 36.5 has been provided. The chambers 16.1, 16.2, 16.3 of the three sections 36.1, 36.2, 36.3 which, with respect to the transport direction of the web 07 of material, are located upstream in the dryer 22 are provided with heated gases from a burner. The chambers 16.4, 16.5 of the two downstream located sections 36.4, 36.5 are provided with unheated fresh air in order to pre-cool the web 07 of material prior to its reaching a group of cooling rollers 29. The output of such a dryer 22 is sufficient for heatset drying.

The fact that the dryer 22, in accordance with the present invention, can be mounted on an existing printing group 21, without increasing the space requirements of the printing group 21 or the required distance of this printing group 21 from other presses of the latter, renders the dryer 22 of the present invention particularly well suited for retrofitting already installed printing presses. In this way, the possibility is provided to also imprint higher quality paper having reduced absorption ability compared to customary newsprint, and in particular, paper with a coated surface, on such presses. The field of application of such printing presses is thus increased, so that they can also be used during the day, at a time during which no newspaper are typically to be printed. Because of this increased utilization, the efficiency of such a printing press can be considerably increased.

While preferred embodiments of a dryer for a web of material, in accordance with the present invention, have been set forth fully and completely hereinabove, it will be apparent to one of skill in the art that various changes in, for example, the specific structure of the press components, the type of pressure pumps used, and the like could be made without departing from the true spirit and scope of the present invention which is accordingly to be limited only by the following claims.

What is claimed is:

1. A dryer for drying a web of material comprising:

a printing group adapted to print a web, said printing group having a vertical web guidance path;

a dryer housing positioned on said printing group;

a web transit channel in said dryer housing, drying of said web being accomplished in said web transit channel;

at least first and second straight web passage sections in said web transit channel, said web of material passing through said first and second sections in opposite directions of web travel; and a plane defined by a vertical extension of said web guidance path, one of said at least first and second sections being arranged on only one side of said plane, another of said at least first and second sections being arranged on both sides of said plane.

2. The dryer of claim 1 further including at least one curved change of direction surface, about which said web of material is looped, said at least one curved change of direction surface being located at at least one of an inlet to one of said sections, an outlet from one of said sections and between two of said sections.

3. The dryer of claim 2 wherein said change of direction surface has a radius of curvature, said radius of curvature being variable in said direction of web travel and being a minimum at a vertex line of said change of direction surface and which increases toward an edge of said change of direction surface.

4. The dryer of claim 2 further including air outlet openings along a vertex line of said change of direction surface.

5. The dryer of claim 1 further including heat sources in said transit channel.

6. The dryer of claim 1 further including air outlet openings arranged on at least one of said straight sections of said transit channel.

7. The dryer of claim 6 further including a heating device in a supply line to said air outlet openings.

8. The dryer of claim 7 wherein said heating device is a burner.

9. The dryer of claim 6 further including a pressure pump adapted to supply air to said air outlet openings.

10. The dryer of claim 1 wherein said transit channel has a plurality of said air outlet openings and further wherein a heating device is provided in a supply line to said air outlet openings in at least one of said sections located upstream in the running direction of the web and is absent in a supply line to said air outlet openings in at least one of said sections located downstream in the running direction of the web.

11. The dryer of claim 1 further including a suction pump adapted to form a negative pressure in said web transit channel.

12. The dryer of claim 1 wherein said first section extends from a dryer inlet in a first one of said opposite directions over a first distance, wherein said second section extends from said first section in a second one of said opposite direction over a second distance greater than said first distance and further including a change of direction surface between said first section and said second section.

13. The dryer of claim 12 wherein said second distance is at least twice as long as said first distance.

* * * * *